United States Patent [19]

Kato et al.

[11] Patent Number: 5,019,186

[45] Date of Patent: May 28, 1991

[54] PROCESS FOR PRODUCING CHROMIUM-CONTAINING STEEL SHEET HOT-DIP PLATED WITH ALUMINUM

[75] Inventors: Yasushi Kato; Keiichi Yoshioka; Osamu Hashimoto, all of Chiba, Japan

[73] Assignee: Kawasaki Steel Corporation, Hyogo, Japan

[21] Appl. No.: 539,968

[22] Filed: Jun. 15, 1990

[30] Foreign Application Priority Data

Jun. 23, 1989 [JP] Japan ..... 1-161925

[51] Int. Cl.[5] ..... C25D 5/00; B32B 15/18

[52] U.S. Cl. ..... 148/20.3; 148/15; 204/38.5; 427/320; 428/653

[58] Field of Search ..... 148/20.3, 15; 428/653; 427/320; 204/38.5

[56] References Cited

U.S. PATENT DOCUMENTS 4,584,211 4/1986 Higuchi et al. ..... 427/320
4,655,852 4/1987 Rallis ..... 148/14
4,675,214 6/1987 Kilbane et al. ..... 427/320
4,797,329 1/1989 Kilbane et al. ..... 428/653
4,800,135 1/1989 Kilbane et al. ..... 428/653
4,883,723 11/1989 Kilbane et al. ..... 427/320
4,891,274 1/1990 Higuchi et al. ..... 428/653
4,913,785 4/1990 Uchida et al. ..... 204/38.5
4,940,638 7/1990 Adaniya et al. ..... 428/653

*Primary Examiner*—Upendra Roy
*Attorney, Agent, or Firm*—Austin R. Miller

[57] ABSTRACT

A method of producing a chromium-containing steel sheet hot-dip plated with aluminum. A steel sheet containing not less than about 3 wt % of chromium is pre-plated at each side thereof with an iron-phosphor alloy so that a pre-plating layer of the iron-phosphor alloy about 0.05 to 3.0 μm thick is formed on each side of the steel sheet. The steel sheet is heated and then subjected to an aluminum hot-dip plating by being dipped in a bath of molten aluminum or a molten aluminum alloy. An undercoat nickel plating layer may be formed on the steel sheet in advance of pre-plating with the iron-phosphor alloy.

4 Claims, 4 Drawing Sheets

PROCESS FOR PRODUCING CHROMIUM-CONTAINING STEEL SHEET HOT-DIP PLATED WITH ALUMINUM

BACKGROUND OF THE INVENTION

1. Field of the Invention

The present invention relates to a process for producing a chromium-containing steel sheet hot-dip plated with aluminum, improved both in aluminum hot-dip plating characteristics and in plating adhesion.

2. Description of the Related Art

Ferrous sheet materials having superior resistance to corrosion, heat and oxidation have been known, a typical example being aluminum-plated carbon steel sheets and stainless steel sheets. Among these known materials, aluminum-plated carbon steel sheet is less expensive as compared with a stainless steel sheet containing about 7 wt. % of chromium and yet exhibits superior resistance to corrosion, heat and oxidation which well compare with those exhibited by the above-mentioned stainless steel sheet. For these reasons, the aluminum-plated carbon steel sheets are widely used in structures which are required to have high resistance to corrosion, heat and oxidation, such as exhaust pipes of automotive engines, for example.

In recent years, however, the use of aluminum-plated carbon steel sheets is being restricted for prevention of environmental pollution. On the other hand, the current trend for higher performance of automobiles has given rise to the demand for materials which have higher resistance to corrosion, heat and oxidation.

In particular, corrosion resistance of this type of material is significantly influenced by the quality of the plating, since any flaw in the plating layer allows generation of rust on the surface of the underlying metal exposed through the flaw. Such rust tends to rapidly grow to cause pitting to perforate or corrode the material quite rapidly.

There is also a trend toward automobiles of front-engine front-drive type in which the distance between the engine and the exhaust muffler is rather long. In addition, automobiles in city areas are usually driven only short distances so that engines are often turned off before the temperature in the muffler is raised to a high temperature. Consequently, exhaust gases are cooled and condensed into liquid form in the exhaust pipes and mufflers to promote corrosion of the exhaust pipes and mufflers by corrosive ions such as $SO_4$—, Cl— and $CO_3$— which are contained in the condensate stagnating in the exhaust pipe and muffler. Higher corrosion resistance is required also from this point of view.

Under these circumstances, 11%-chromium stainless steel and 13% chromium stainless steel, which can be produced at low cost and which exhibit superior corrosion resistance, are becoming popular as the materials of exhaust gas-systems of automotive engines which are required to have high corrosion resistance, particularly in North American countries. These materials, however, are still unsatisfactory in that red rust tends to be generated after the material is formed into an exhaust pipe, particularly at weld portions of the pipe.

In order to obviate thee problems, U.S. Pat. No. 4,675,214 proposes the use of an aluminum hot-dip plated stainless steel in which stainless steel as a corrosion-resistant base material is hot-dip plated with aluminum.

This material exhibits superior resistance to corrosion at portions of underlying base material exposed through flaws in the plating layer, as well as at welded portions, thus providing an effective countermeasure to pitching corrosion which has been one of the critical problems.

The aluminum hot-dip plated stainless steel disclosed in the above-mentioned United States Patent is produced by a process in which a stainless steel sheet is dipped in a plating bath of molten aluminum, after the surface of the steel sheet is cleaned by treatment of the steel in a reducing gas atmosphere for reducing oxides of chromium, silicon and manganese which are densely generated on the pole surface of the steel sheet.

The reduction of these oxides essentially requires that the reducing gas atmosphere be controlled to contain hydrogen gas of high density and oxygen gas of low density and low dew point. Formation of such a reducing gas atmosphere requires expensive and complicated equipment, as well as complicated control.

It is true that any oxide mentioned above, remaining on the surface of the stainless steel sheet to be plated, is reduced during subsequent dipping due to the strong reducing effect produced by the aluminum so that the surface of the steel sheet is cleaned. However, if nitrogen is contained in the reducing gas, CrN is generated on the surface of the steel sheet so as to impair generation of aluminum-iron alloy layer on the steel sheet surface during dipping in the aluminum bath, resulting in a plating defects.

Thus, it has been necessary to reduce the nitrogen gas content while increasing the hydrogen gas content in the atmosphere gas.

The aluminum-iron alloy layer which is formed on the steel sheet surface during aluminum hot-dip plating is generally fragile. Therefore, this alloy layer which forms the boundary between the plating layer and the iron as the base metal when, for example, the plated sheet is subjected to bending work, particularly when the thickness of this alloy layer is large, thus increasing the risk of separation of the aluminum plating layer.

SUMMARY OF THE INVENTION

Accordingly, an object of the present invention is to provide a process for producing a chromium-containing steel sheet hot dip plated with aluminum which enables, with simple equipment and operation, creation of a corrosion-resistant steel sheet with improved aluminum plating characteristic and high aluminum plating adhesion, thereby overcoming the above described problems encountered with the conventional process for producing aluminum hot-dip plated steel sheet and also with the steel sheet itself.

The present inventors have conducted an intense study and found that the above-described object of the invention is achieved by using a process for producing chromium-containing double-side aluminum hot-dip plated steel sheet having the following features.

Namely, according to the present invention, there is provided a method of producing a chromium-containing steel sheet hot-dip plated with aluminum, comprising: preparing a steel sheet containing not less than about 3 wt. % of chromium; pre-plating each side of the steel sheet with an iron-phosphor alloy so as to form a pre-plating layer of the iron-phosphor alloy about 0.05 to 3.0 μm thick on each side of the steel sheet; heating the steel sheet in a non-oxidizing atmosphere; and dipping the steel sheet in bath of molten aluminum or a molten aluminum alloy.

Preferably, an undercoat nickel plating layer of about 0.005 to 3.0 μm thick is formed on each side of the steel sheet before the pre-plating with the iron-phosphor alloy.

Preferably, the phosphor content of the pre-plating layer of iron-phosphor alloy is about 0.05 to 1.5 wt. %.

It is also preferred that the bath of molten aluminum alloy contains about 3 to 13 wt. % of silicon.

The above and other objects, features and advantages of the present invention will become clear from the following description when the same is read in conjunction with the accompanying drawings.

DESCRIPTION OF THE PREFERRED EMBODIMENT

Figure 1:
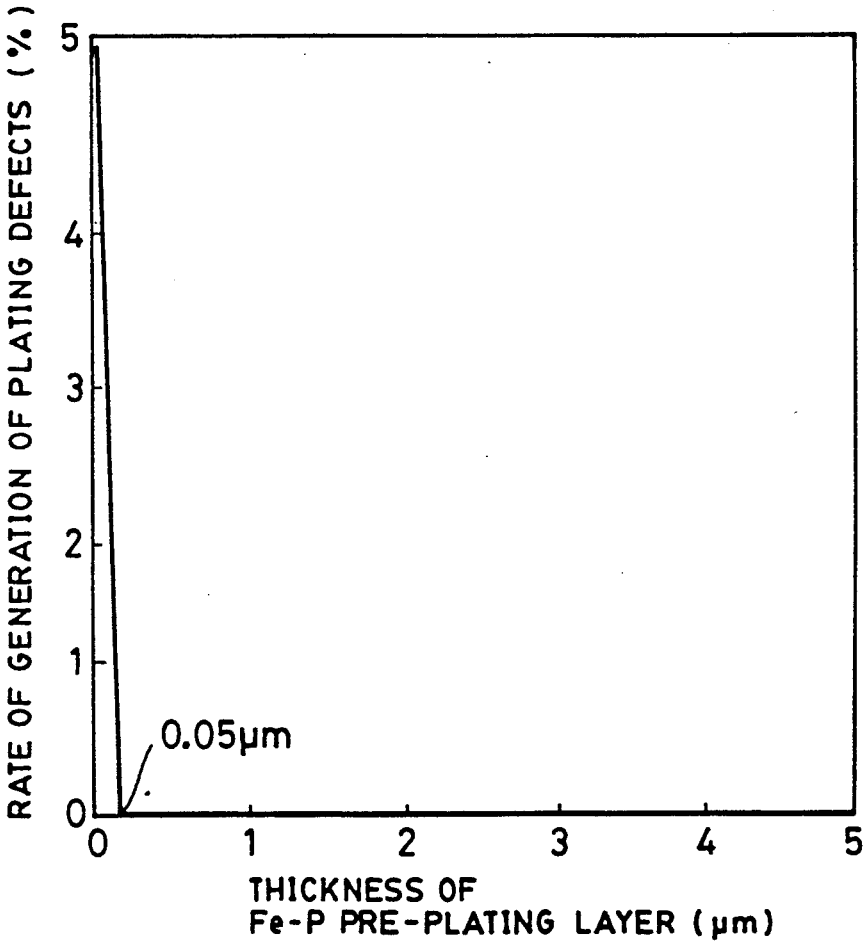
FIGS. 1 and 2 are graphs showing respectively (1) the relationship between the thickness of an iron-phosphorus plating layer and rate of generation of plating defects and (2) the relationship between the above-mentioned thickness and the plating adhesion.

The steel sheet used as the base metal in the present invention is a steel sheet containing not less than 3 wt. % of chromium, such as a stainless steel sheet or a heat-resistant steel sheet. The term "steel sheet" as used in this specification is intended to include also a band steel or a hoop, for example.

Chromium content below 3 wt. % is not preferred because it impairs corrosion resistance.

In general, steel sheets of the kind mentioned above contain various elements according to use, such as nickel (approx. 0 to 0.5 wt. %), titanium (approx. 1 to 0.5 wt. %), molybdenum (approx. 0 to 2.5 wt. %), aluminum (approx. 0 to 5 wt. %),zirconium (approx. 0 to 0.5 wt. %), manganese (approx. 0 to 2 wt. %), silicon (approx. 0 to 1 wt. %), copper (approx. 0 to 1 wt. %), vanadium (approx. 0 to 0.5 wt. %), and so forth. These elements, when their contents fall within ordinary ranges such as those shown above, do not affect the concept of the present invention, so that the process of the present invention does not exclude the use of steel sheets containing these elements in amounts such as shown above.

The gist of the present invention resides in that the aluminum plating characteristic and aluminum plating adhesion are remarkably improved by forming, in advance of the aluminum hot-dip plating, a pre-plating iron-phosphorus alloy plating layer of about 0.05 to 3.0 μm thick on each side of a steel sheet containing not less than about 3 wt. % of chromium.

The phosphor content of the pre-plating layer is preferably about 0.05 to 1.5 wt. %. The pre-plating iron-phosphorus alloy plating layer cannot provide an appreciable effect in improving hot-dip plating characteristics and hot-dip plating adhesion, when the phosphor content is below about 0.05 wt. %. On the other hand, when the phosphor content exceeds about 1.5 wt. %, the melting point of the pre-plating layer is lowered to pose a problem in the aluminum hot-dip process in which the steel sheet is heated.

The heating of the steel sheet conducted in advance of aluminum hot-dip plating is conducted in an atmosphere of a non-oxidizing gas. If this heating is conducted in an oxidizing gas atmosphere, the pre-plating layer is heavily oxidized to make it impossible to achieve the object of the present invention. The non-oxidizing gas preferably used as the heating atmosphere is hydrogen gas, nitrogen gas, argon gas or a mixture of these gases.

The pre-plating iron phosphorus alloy plating layer remarkably improves the plating characteristics (characteristics for forming a plating layer). In order to fully enjoy this advantage, it is necessary that the pre-plating be conducted to provide a pre-plating layer of about 0.05 to 3.0 μm thick on each side of the steel sheet. A pre-plating layer thickness less than about 0.05 μm causes hot-dip plating defects, while a pre-plating layer thickness exceeding about 3.0 μm causes a reduction in the plating adhesion after the hot-dip aluminum plating, although hot-dip plating defects are avoided.

Only one pre-plating layer or two or more such layers may be formed for the purpose of improving plating adhesion between the pre-plating layer and the iron which is the base metal. In this invention, it is possible to form a nickel undercoat plating layer of about 0.005 to 3.0 μm before the pre-plating with iron-phosphorus alloy. When the thickness of the nickel undercoat plating layer is below about 0.005 μm, the adhesion between the nickel undercoat plating layer and the pre-plating iron-phosphorus alloy plating layer which is to be formed thereon is impaired. The plating adhesion also is slightly reduced when the thickness exceeds about 3.0 μm.

The pre-plating may be conducted by any suitable method such as electro-plating, vacuum evaporation, flame spraying and so forth. It is, however, necessary that the pre-plating method does not impart any work strain to the steel sheet during the pre plating, because such work strain undesirably reduces the workability of the plated steel sheet. Among various methods reported heretofore, electro-plating, vacuum evaporation and flame spraying are preferred because these methods do not apply substantial work strain to the steel sheet during pre-plating and, hence, do not impair workability of the product plated steel sheet when the sheet is worked into, for example, a pipe.

It is also possible to effect a pre-treatment on the surface of the steel sheet in advance of the pre-plating.

An example of such pre-treatment advantageously employed is an activation treatment which is carried out with hydrochloric acid or sulfuric acid. This activation treatment is effective in improving plating adhesion.

According to the present invention, a steel sheet having a pre-plating layer formed by the above-described method is heated under the conditions mentioned before and is then subjected to aluminum hot-dip plating.

The aluminum hot-dip plating is conducted by using a molten aluminum bath, more particularly a bath of substantially pure molten aluminum which may contain incidental impurities, or with a bath of a molten aluminum alloy. A preferred example of aluminum alloy bath is an aluminum-silicon bath containing about 3 to 13 wt. % of silicon.

The aluminum hot-dip plating may be conducted in a batch-type fashion or continuously through a known process.

The thickness of the aluminum hot-dip plating layer is usually about 15 to 60 μm, though there is no restriction in the thickness of this layer.

DESCRIPTION OF THE PREFERRED EMBODIMENT

An embodiment of the present invention will be described by way of example. It is to be understood, however, these Examples are only for illustrative purposes and are not intended to limit the scope of the present invention.

EXAMPLE 1

A cold rolled steel sheet 0.7 mm thick was prepared from a steel material having a composition of 0.01 wt. % C—0.4 wt. % Si—0.3 wt. % Mn—11.0 wt. % Cr—0.12 wt. % Ti. A pre-plating layer of an iron-phosphorus alloy was formed on each side of the above-mentioned steel sheet. The pre-plating was conducted by using a cathodic electrolytic process in an aqueous solution of 40° C. and pH 1.8, at a current density of 10A/dm$^2$. The aqueous solution contained 250 g/l of ferrous sulfate, 120 g/l of ammonium sulfate, and 0.2 g/l of sodium phosphinate monoydrate. In consequence, an iron—0.3 % phosphor pre-plating layer having a thickness of 0.03 to 5 μm was formed on each side of the steel sheet.

Figure 3:
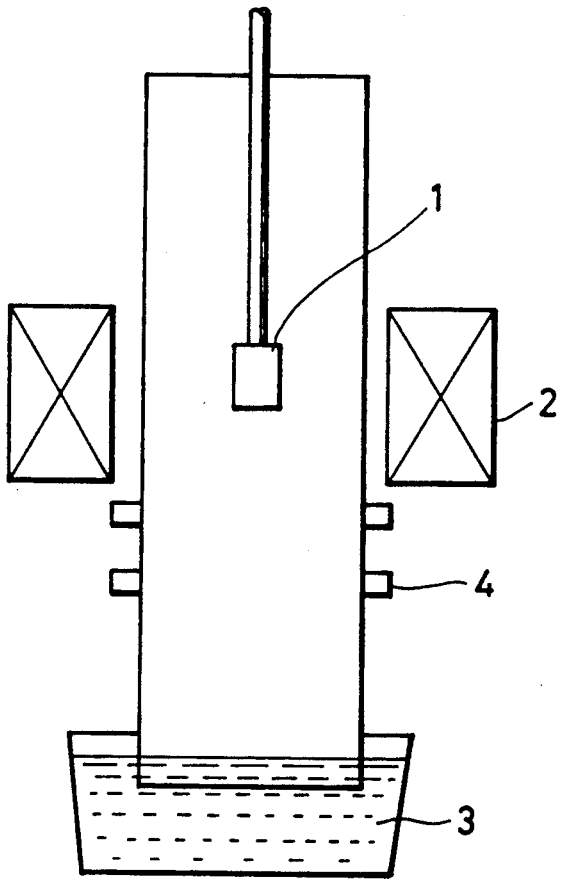
FIG. 3 is a schematic illustration of a vertical hot-dip plating simulator.

The steel sheet pre-plated at each side thereof was subjected to aluminum hot-dip plating conducted by a vertical hot dip plating simulator of the type which is shown in FIG. 3. The hot-dip plating was executed by heating the steel sheet to 900° C. and then cooling the same to 680° C. in an atmosphere shown below, followed by 7-second dipping in a bath. In FIG. 3, numeral 1 denotes a steel sheet, 2 denotes an infrared heating oven, 3 denotes a bath of molten aluminum and 4 denotes an atmosphere gas introduction port. A molten aluminum alloy of 91% Al—9% Si was used as the material of the aluminum plating bath. The bath temperature was 660° C. A hydrogen/nitrogen mixed gas containing 20 vol% of hydrogen and having a dew point of −15° C. was used as the atmosphere in the heating and hot-dipping of the steel sheet.

The characteristics of the chromium-containing steel sheet aluminum hot-dip plated at its both sides were measured and evaluated. The results are shown in FIG. 1, which is a graph showing the relationship between the thickness of the iron-phosphorus (Fe—P) pre-plating layer and the rate of generation of plating defects, and also in FIG. 2 which shows the relationship between the thickness of the Fe—P pre-plating layer and the plating adhesion.

The term "rate of generation of plating defects" is a factor expressed in terms of percentage. The rate of generation of plating defects in determined to be equal to $$\{(\text{area of defective plating measured by visual observation})/(\text{measured area})\} \times 100\ (\%)$$

The term "plating adhesion" is a factor which is determined by subjecting the chromium-containing aluminum hot-dip plated steel sheet to a so-called 0T (zero-thickness) bending test and evaluating the degree of separation of the plating layer observed through a magnifier at a magnification of 20.

Figure 2:
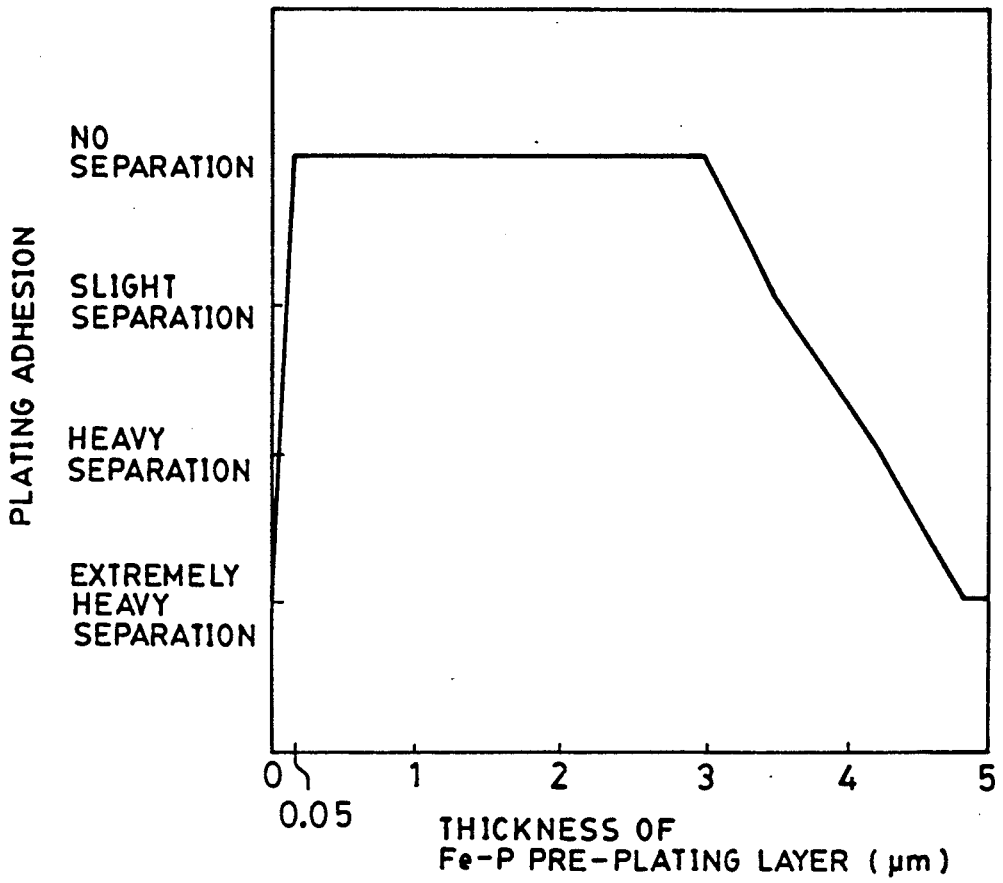

In FIG. 1 it is shown that the iron-phosphorus pre-plating layer cannot provide a satisfactory effect in preventing generation of plating defects when the thickness of this layer is below about 0.05 μm. It is also demonstrated by FIG. 2 that, when the thickness of the iron-phosphorus pre-plating layer exceeds about 0.05 μm, the aluminum hot-dip plating adhesion is remarkably improved but the plating adhesion is reduced when the thickness of the pre-plating layer exceeds about 3.0 μm. Thus, the adhesion of the aluminum hot-dip plating layer is remarkably improved when the thickness of the iron-phosphor pre-plating layer is in the range of about 0.05 to 3.0 μm. This remarkable effect is considered to be attributable to suppression of growth of the aluminum-iron (Al—Fe) alloy layer effected by the iron-phosphorus pre-plating layer. It is also considered that, when the thickness of the pre-plating layer exceeds about 3.0 μm, the total thickness of the iron-aluminum (Fe—Al) layer and the pre-plating layer becomes so large as to allow easy separation of the hot-dip plating layer.

EXAMPLE 2

Figure 4:
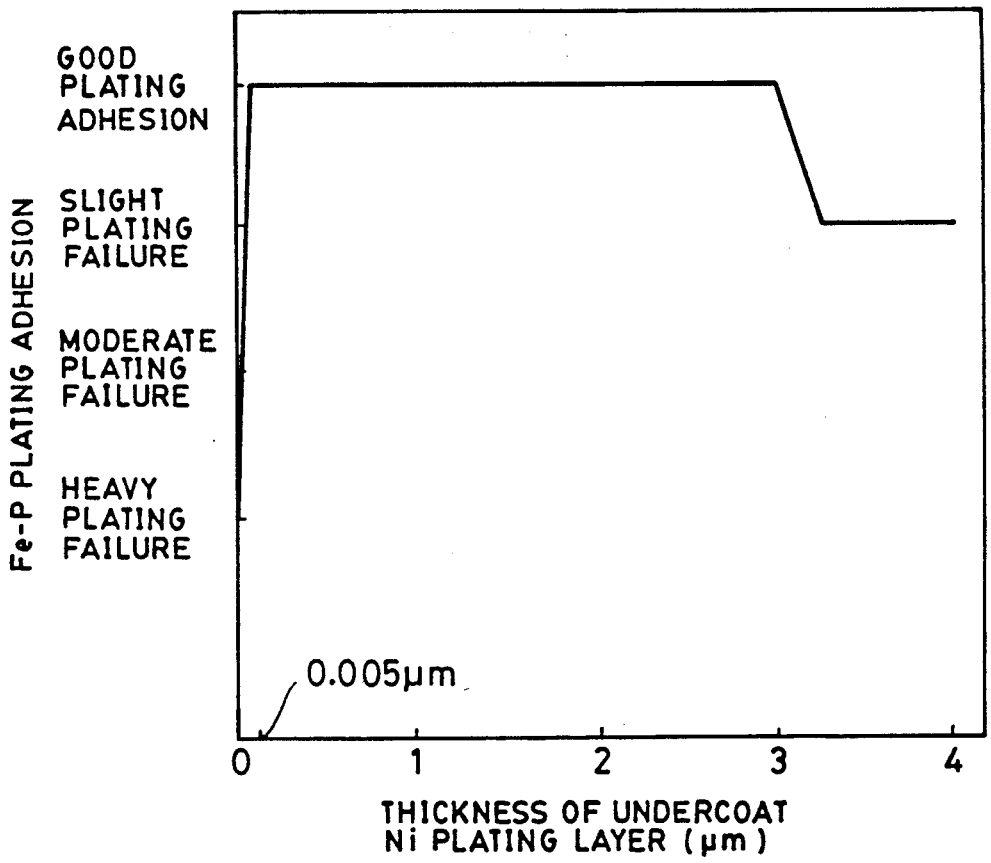
FIG. 4 is a graph showing the relationship between the thickness of nickel plating layer and adhesion of Fe—P plating.

Nickel plating and plating with 99.7% iron—0.3% phosphorus were sequentially conducted on a cold-rolled steel sheet having the same composition. The hot-dip plating adhesion was examined in the same manner as in Example 2, on a steel sheet having a dual pre-plating layer, i.e., a nickel plating layer and an iron-phosphorus layer 0.4 μm thick, the results being shown in FIG. 4. From FIG. 4, it will be seen that firm iron-phosphorus plating adhesion is obtained by the undercoat Ni plating layer, and that this effect is remarkable particularly when the thickness of the undercoat Ni plating layer is about 0.005 to 3.0 μm.

(1) Conditions of nickel plating were as follows:

| | |
|---|---|
| nickel sulfate | 280 g/l |
| nickel chloride | 50 g/l |
| boric acid | 40 g/l |
| pH | 1.6 |
| temperature | 50° C. |

cathodic electrolysis current density 5 to 15A/dm$^2$ The amount of plating nickel was controlled by changing electrolytic processing time.

(2) Conditions of iron-phosphor plating were as follows:

| | |
|---|---|
| ferrous chloride | 240 g/l |
| potassium chloride | 180 g/l |
| sodium phosphinate monohydrate | 0.2 g/l |
| pH | 2.0 |
| temperature | 40° C. |

cathodic electrolysis current 15A/dm$^2$×15 sec

EXAMPLE 3

A 99.7% iron —0.3% phosphorus plating layer 0.25 μm thick was formed on a cold-rolled steel sheet of the same composition as that in Example 1 and under the same iron-phosphorus plating conditions as those in Example 1. The steel sheet was heated to 900° C. and then cooled to 680° C. in various atmospheres shown in Table 1, followed by 7-second dipping in a 91% Al—9% Si bath (660° C.) for aluminum hot-dip plating. The results of measurement of the rate of generation of plating defects are shown in Table 1.

Table 1 shows that hot-dip plating adhesion cannot be improved even when the iron-phosphorus (Fe—P) pre-plating is conducted, if the heating and dipping are conducted in an oxidizing gas atmosphere.

TABLE 1

| Atmosphere Gas | Rate of Generation of Plating Defects |
|---|---|
| $N_2$ – 20% $H_2$ | 0% |
| $N_2$ | 0% |
| $H_2$ | 0% |
| $N_2$ – 30% $H_2$ | 0% |
| $N_2$ – 2% $O_2$ | ≧10% |
| Ar + 3% $O_2$ | ≧10% |
| $N_2$ + 10% $CO_2$ | ≧10% |

EXAMPLE 4

Samples were produced from steel sheets having various compositions as shown in Table 2. Pre-plating with iron-phosphorus alloy was conducted by using a sulfate bath with the amount of P ions in the bath controlled to change the content of phosphorus in the plating layer. Ni plating also was conducted under the same conditions as those employed in Example 2. Fe plating on a comparison example was conducted under known plating conditions. The compositions and plating conditions of the samples including comparison examples are shown in Table 3.

TABLE 2

| | COMPOSITION OF TESTED SAMPLES (wt %) | | | | | | | | |
|---|---|---|---|---|---|---|---|---|---|
| Steel No. | C | Si | Mn | Cr | Ni | Ti | Nb | Mo | Cu |
| 1 | 0.01 | 0.2 | 0.2 | 3.9 | — | — | — | — | — |
| 2 | 0.02 | 0.4 | 0.4 | 11.2 | — | 0.2 | — | — | — |
| 3 | 0.02 | 0.3 | 0.5 | 19.2 | — | — | 0.25 | 0.3 | — |
| 4 | 0.01 | 0.4 | 0.4 | 22.0 | — | — | — | — | 0.3 |
| 5 | 0.03 | 0.7 | 1.2 | 16.4 | 14.1 | — | — | — | — |
| 6 | 0.02 | 0.3 | 0.2 | 7.5 | 0.2 | — | 0.2 | — | — |
| 7 | 0.02 | 0.4 | 0.4 | 11.2 | — | 0.2 | — | — | — |
| 8 | 0.02 | 0.4 | 0.4 | 11.2 | — | 0.2 | — | — | — |
| 9 | 0.02 | 0.4 | 0.4 | 11.2 | — | 0.2 | — | — | — |
| 10 | 0.01 | 0.5 | 0.4 | 16.0 | — | — | — | — | — |

TABLE 4

| | Rate of Generation of Plating Defects (%) | Al Hot-dip Plating Adhesion |
|---|---|---|
| Sample of Invention 1 | 0 | No Separation |
| Sample of Invention 2 | 0 | No Separation |
| Sample of Invention 3 | 0 | No Separation |
| Sample of Invention 4 | 0 | No Separation |
| Sample of Invention 5 | 0 | No Separation |
| Sample of Invention 6 | 0 | No Separation |
| Comparison Example 1 | 3 | Slight Separation |
| Comparison Example 2 | ≧10 | Slight Separation |
| Comparison Example 3 | 0 | Slight Separation |
| Comparison Example 4 | ≧10 | Heavy Separation |
| Comparison Example 5 | 4 | Slight Separation |

These samples were then heated and subjected to aluminum plating. Tests and evaluations were conducted on the thus obtained aluminum-plated samples in the same way as that explained in connection with Example 1, the results being shown in Table 4.

As shown in Table 4, all the samples produced in accordance with the method of the present invention were excellent and exhibited no aluminum hot-dip plating defect. Aluminum hot-dip plating adhesion also was superior in each of these samples. It is also understood that, when the iron-phosphorus pre-plating layer is too small in thickness or absent, hot-dip plating defects are generated and the adhesion of aluminum hot-dip plating layer is extremely low, as in the case of the comparison examples 1 and 4. In comparison example 3, the plating adhesion is reduced due to excessive thickness of the pre-plating layer. The results observed in comparison example 2 show that the iron-phosphorus pre-plating layer does not produce any appreciable effect when the heating of the steel sheet prior to the hot-dipping is conducted in an oxidizing atmosphere. Comparison example 5, pre-plated with iron (Fe) containing no phosphorus, showed hot-dip plating characteristics and hot-dip plating adhesion which are inferior to those in the samples produced by the method of the invention.

As has been described, according to the present invention, a chromium-containing steel sheet is pre-plated with a layer of iron-phosphorus alloy or with layers of

TABLE 3

| | Composition and Thickness of First Pre-plate Layer | Composition and Thickness of Second Pre-plate Layer | Steel Heating Condition | | Al Dipping Condition | Al Plating Composition | Al Plating Thickness | Steel No. |
|---|---|---|---|---|---|---|---|---|
| | | | Gas Composition | Temp. | | | | |
| Sample of Invention 1 | Fe-0.2% P/0.4 μm | — | $N_2$-10% $H_2$ | 850° C. | 690° C. × 4 sec | Al | 20 μm | 1 |
| Sample of Invention 2 | Fe-0.9% P/2.2 μm | — | $N_2$-30% $H_2$ | 900° C. | 700° C. × 6 sec | Al | 20 μm | 2 |
| Sample of Invention 3 | Fe-0.3% P/0.1 μm | — | $N_2$ | 770° C. | 650° C. × 5 sec | Al-10% Si | 25 μm | 3 |
| Sample of Invention 4 | Fe-0.2% P/1.3 μm | — | $H_2$ | 950° C. | 640° C. × 5 sec | Al-8% Si | 20 μm | 4 |
| Sample of Invention 5 | Ni/0.01 μm | Fe-0.1% P/0.4 μm | $N_2$-5% $H_2$ | 800° C. | 700° C. × 4 sec | Al | 20 μm | 5 |
| Sample of Invention 6 | Ni/0.3 μm | Fe-0.3% P/1.2 μm | $N_2$-20% $H_2$ | 850° C. | 660° C. × 4 sec | Al-10% Si | 25 μm | 6 |
| Comparison Example 1 | Fe-0.2% P/0.03 μm | — | $N_2$-20% $H_2$ | 900° C. | 690° C. × 5 sec | Al | 20 μm | 7 |
| Comparison Example 2 | Ni/0.01 μm | Fe-0.1% P/1.2 μm | $N_2$-0.2% $O_2$ | 850° C. | 650° C. × 5 sec | Al-10% Si | 25 μm | 8 |
| Comparison Example 3 | Fe-0.9% P/3.8 μm | — | $N_2$-20% $H_2$ | 900° C. | 640° C. × 5 sec | Al-8% Si | 25 μm | 9 |
| Comparison Example 4 | — | — | $N_2$-30% $H_2$ | 850° C. | 700° C. × 5 sec | Al | 20 μm | 10 |
| Comparison Example 5 | Fe/0.4 μm | — | $N_2$-20% $H_2$ | 900° C. | 650° C. × 5 sec | Al-8% Si | 20 μm | 3 |

nickel and an iron-phosphorus alloy, before it is subjected to an aluminum hot-dip plating process. A chromium containing steel sheet hot-dip plated with aluminum produced by this method is substantially free of hot-dip plating defects and exhibits firm, hot-dip plating adhesion, thus offering high resistance to corrosion. Thus, the chromium-containing aluminum hot-dip plated steel sheet produced by the method of the present invention can be used in various fields which require high resistance to corrosion, such as automotive exhaust systems for example.

What is claimed is:

1. A method of producing a chromium-containing steel sheet hot-dip plated with aluminum, comprising: preparing a steel sheet containing not less than about 3 wt. % of chromium; pre-plating each side of said steel sheet with an iron-phosphorus alloy so as to form a pre-plating layer of said iron-phosphorus alloy about 0.05 to 3.0 μm thick on each side of said steel sheet; heating said steel sheet in a non-oxidizing atmosphere; and dipping said steel sheet in a bath of molten aluminum or a molten aluminum alloy.

2. A method according to claim 1, wherein an undercoat nickel plate layer of about 0.005 to 3.0 μm thick formed on each side of said steel sheet before said pre-plating with said iron-phosphorus alloy.

3. A method according to one of claims 1 and 2, wherein the phosphorus content of the pre-plating layer of iron-phosphor alloy is about 0.05 to 1.5 wt. %.

4. A method according to one of claims 1 to 2, wherein said bath of molten aluminum alloy contains about 3 to 13 wt. % of silicon.

* * * * *